US005537756A

United States Patent [19]

Haessner et al.

[11] Patent Number: 5,537,756

[45] Date of Patent: Jul. 23, 1996

[54] DEVICE FOR EVACUATING CONDENSATE FROM A FLUTED DRYING CYLINDER BY MEANS OF CONDENSATE EVACUATION PIPES

[75] Inventors: Winfried Haessner; Iwan Lasschuit, both of Heidenheim, Germany

[73] Assignee: Voith Sulzer Papiermaschinen GmbH, Heidenheim, Germany

[21] Appl. No.: 392,777

[22] PCT Filed: Jun. 30, 1994

[86] PCT No.: PCT/DE94/00750

§ 371 Date: Mar. 31, 1995

§ 102(e) Date: Mar. 31, 1995

[87] PCT Pub. No.: WO95/01477

PCT Pub. Date: Jan. 12, 1995

[30] Foreign Application Priority Data

Jul. 1, 1993 [DE] Germany ..... 43 21 902.0

[51] Int. Cl.[6] ..... F26B 11/02

[52] U.S. Cl. ..... 34/119; 34/124; 165/89

[58] Field of Search ..... 34/119, 124, 125; 165/89, 90

[56] References Cited

U.S. PATENT DOCUMENTS

| | | | |
|---|---|---|---|
| 1,537,792 | 5/1925 | Aucutt | 34/125 |
| 3,473,238 | 10/1969 | Talley, Jr. et al. | 34/125 |
| 3,513,565 | 5/1970 | Jacobson | 34/125 |
| 3,808,700 | 5/1974 | Kraus | 34/125 |
| 4,359,829 | 11/1982 | Schiel | 34/125 |
| 4,476,637 | 10/1984 | Justus et al. . | |
| 4,501,075 | 2/1985 | Jenkner et al. | 34/119 |
| 5,335,427 | 8/1994 | Partio | 34/124 |

FOREIGN PATENT DOCUMENTS

| | | |
|---|---|---|
| 360834 | 2/1981 | Germany . |
| 2011025 | 7/1979 | United Kingdom . |

*Primary Examiner*—John T. Kwon
*Attorney, Agent, or Firm*—Taylor & Knuth

[57] ABSTRACT

The invention is directed to a device for evacuating condensate from a rotary, steam-heated drying cylinder or the like, in particular the drying cylinder of a paper machine, having a plurality of grooves provided at the inner wall in the circumferential direction of the cylinder jacket, and a condensate evacuation pipe which may be associated with the grooves and which supplies the condensate produced to a collector and then to a condensate discharge pipe. The condensate evacuation pipes are fixed in the area of the associated grooves at a predetermined distance from the bottom of the grooves. A flexible connection element functionally connects the condensate evacuation pipes to the collector.

12 Claims, 4 Drawing Sheets

DEVICE FOR EVACUATING CONDENSATE FROM A FLUTED DRYING CYLINDER BY MEANS OF CONDENSATE EVACUATION PIPES

BACKGROUND OF THE INVENTION

1. Field of the Invention

The present invention relates to a device for removal of condensate from a fluted drying cylinder.

2. Description of the Related Art

Known for solving the problem of evacuating the condensate accumulating in the interior of a steam-heated drying cylinder are already many different designs. The ultimate concern is to pass the condensate forming as the superheated steam introduced in the interior of the drying cylinder cools down to the outside (to a steam separator), in order to keep the inside wall of the drying cylinder, and thus the drying cylinder itself, as much as possible at a constant operating or working temperature. The superheated steam is supplied through a steam pipe situated coaxially to the bearing of the drying cylinder; the condensate itself passes via the condensate evacuation pipe to a collector and a hollow shaft mounted coaxially in the drying cylinder, whence the condensate is evacuated via a condensate discharge pipe which extends through the steam pipe or through the diametral end face of the drying cylinder.

The prior art relevant to "dewatering systems for fluted drying cylinders" includes three designs:

It is known to fix condensate collectors on the inside ribbing of the cylinder shell and to connect them to an inner hollow shaft. In the area of the hollow shaft, the connection is based on unique ball joint elements, and a length compensation element is provided toward the collector. In actual operation it has been demonstrated that the collector causes deformations of the cylinder shell. The result is a non-uniform and, as the case may be, incomplete dewatering, which ultimately may lead to a degraded paper quality.

Another known design comprises fastening the collector to the hollow shaft and supporting it on the covers of the drying cylinder; thus the cylinder is not in contact with the inside of the cylinder shell. This configuration has been found to be disadvantageous in that the position of the condensate pipes changes relative to the groove bottom, due to thermal expansion of the collector in transverse direction; the result again being a non-uniform and incomplete dewatering. Another difficulty with this design is that the bearing forces, or mass forces, of the collector burden the cylinder cover.

A third relevant concept is characterized in that the collectors are fixed only on the hollow shaft, making contact neither with the cylinder shell nor the cylinder covers. The dewatering itself takes place by way of extended dewatering tubes which protrude sideways from the collector, are fixed on the grooves of the cylinder shell and are adjustable relative to the groove bottom.

Viewed in terms of function, this prior design meets its objective in which context it is particularly noted that the long dewatering tubes assure a spatial degree of freedom. The disadvantage of this design is that the dewatering tubes are very complex and thus expensive components.

A problem underlying the present invention consists in providing a device for evacuating condensate from a fluted drying cylinder, wherein the condensate evacuation pipes functioning as dewatering tubes allow a simpler and thus more low-cost manufacture.

SUMMARY OF THE INVENTION

The present invention provides a flexible connecting element for establishing the functional connection of the condensate evacuation pipes to the collector within a drying cylinder of a paper machine.

The present invention consists in integrating the condensate evacuation pipes by way of an element for absorption and compensation of mechanical shifts between the condensate evacuation pipes and collector, thus safeguarding that the condensate evacuation pipes will at all times and under any given operating conditions be positioned at a constant spacing relative to the groove bottom.

Accordingly, two basic solutions consist in coupling the condensate evacuation pipes by way of a corrugated hose, as connecting hose or via a compensator, as compensating element, to the collector.

Advantages of the present invention include: 1) no or only little loading on the cylinder wall and cylinder covers; 2) adjustability of the condensate evacuation pipes relative to the groove bottom; and 3) simple exchangeability of condensate evacuation pipes in case of wear.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
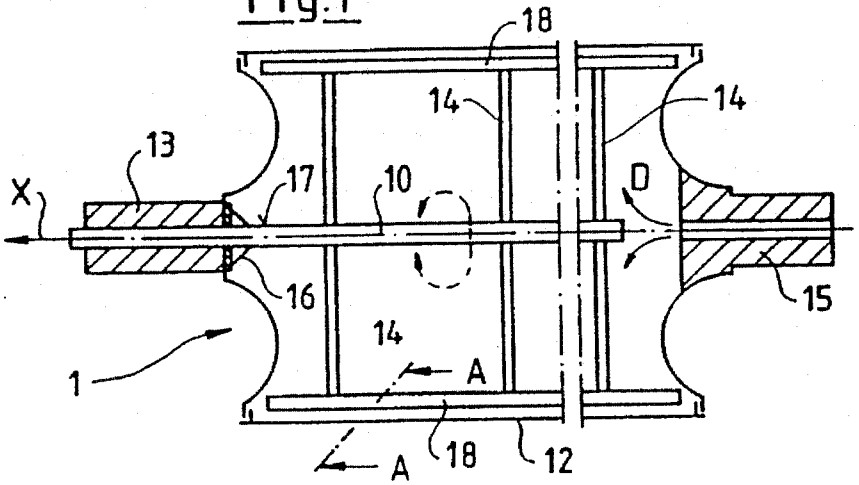
FIG. 1 is a schematic illustration of a drying cylinder of a paper machine in longitudinal section.

FIG. 1 shows a drying cylinder referenced 1 overall and featuring in customary fashion an internally fluted (refer to FIGS. 2 through 5) cylinder shell 12 and, on each end, a cylinder cover with a pertaining hollow journal 13, 15, respectively. Drying cylinder 1 is heated with superheated steam D which proceeds through the one journal 15 (at the right in the drawing) into the interior of drying cylinder 1. The condensate forming inside drying cylinder 1 due to cooling is passed to a hollow shaft 17 by means of several condensate risers 14 which in spider fashion are distributed across the circumference. Hollow shaft 17 passes coaxially with the axis of rotation 10 of drying cylinder 1 through second journal 13 (at the left in the figure) and carries the condensate to a condensate evacuation line (refer to arrow X) which feeds it, e.g., to a steam separator. Hollow shaft 17 is mounted on journal 13 by means of a bracket 16 and extends outward, through the journal, where it hooks to condensate evacuation line X.

The radially outer ends of condensate risers 14 connect to a collector 18 which is spaced from the inside wall of drying cylinder 1 and extends as a single, or alternatively several pieces essentially across the entire length of drying cylinder 1. Collector 18, in turn, connects to a plurality of condensate evacuation pipes 20 (FIGS. 2 through 5), each of which is of assigned individually to a groove of the fluted inside wall drying cylinder 1 and extends into the groove. Condensate forming in the grooves is sucked into the condensate evacuation pipes due to the pressure difference between the interior of drying cylinder 1 and condensate evacuation line X, and passed outside via collector 18, condensate risers 14 and hollow shaft 17. (For the sake of completeness it is mentioned that the steam supply and condensate removal could take place also via a common, so-called steam head.)

Figure 2:
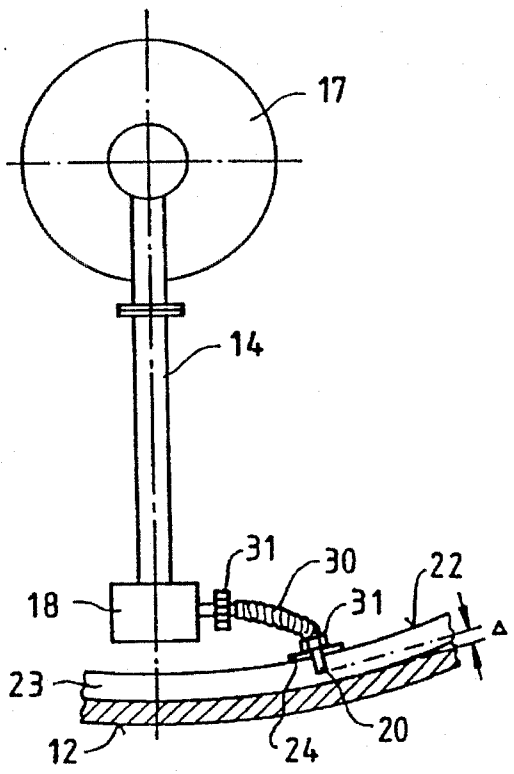
FIG. 2 is a side elevational view of an embodiment of the device for condensate removal of the present invention with the condensate evacuation pipes connected to the collector by a corrugated hose.
Figure 3:
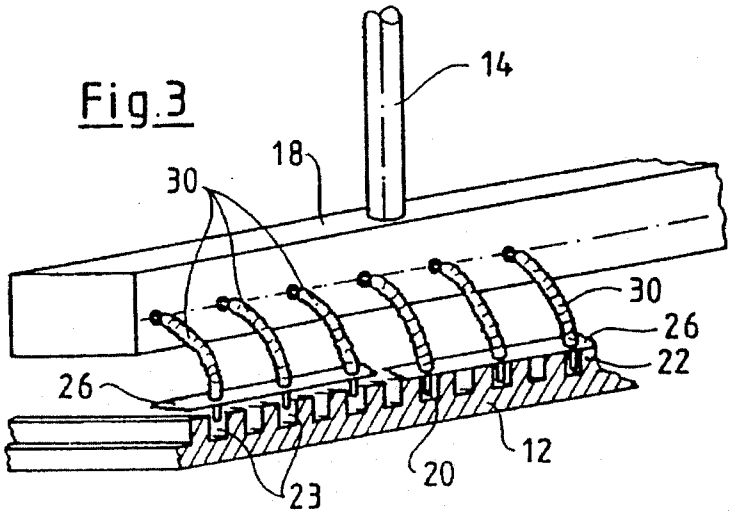
FIG. 3 is a perspective, sectional view taken along line A—A in FIG. 1.

An embodiment of the present invention is more particularly shown in FIGS. 2 through 5, which illustrate hereafter the details concerning the arrangement and coordination of condensate evacuation pipes 20 in drying cylinder 1. FIGS. 2 and 3 show two different basic illustrations of the functional connection between condensate evacuation pipes 20, and collector 18. Collector 18 connects via condensate riser 14 in fixed fashion to hollow shaft 17 without making contact with the inside wall of the cylinder, i.e., ribbing 22 of fluted cylinder shell 12. Collector 18 may basically have any geometric hollow shape.

Condensate evacuation pipes 20, individually or—as shown in FIG. 3—bundled, are fixed on ribbing 22 of cylinder shell 12 by means of a mounting strap 24 (FIG. 2) or a mounting bar 26 (FIG. 3). The dimensioning and mutual adaptation in width, of mounting strap 24 or mounting bar 26, are such that condensate evacuation pipes 20 are always allowed to freely enter grooves 23 and will not be affected in any way either by thermal expansion of the various components. Furthermore, condensate evacuation pipes 20 are connectable, and connected, to mounting strap 24, or mounting bar 26, in a way such that their penetration depth (Δ) in respective groove 23 can be selected freely. This allows very specific adjustment of different thermal drying conditions across the width of drying cylinder 1.

In view of the embodiments relative to FIGS. 2 and 3, one aspect of the present invention consists in coupling condensate evacuation pipes 20 to collector 18 through a corrugated hose 30, which absorbs virtually any relative motion between cylinder shell 12 and collector 18 as well as hollow shaft 17. Corrugated hose 30 is attached to condensate evacuation pipe 20 and sideways, i.e., parallel to the peripheral direction of cylinder shell 12, a protruding port of collector 18 by means of a union nut 31. This allows ultimately also a simple exchange or replacement of condensate evacuation pipes 20 in case of wear and/or other damage.

The dewatering concept for drying cylinders of paper machines as illustrated with the aid of FIGS. 2 and 3 thus avoids application of forces upon cylinder shell 12. As a result, thermal expansions of the components may be disregarded.

Figure 4:
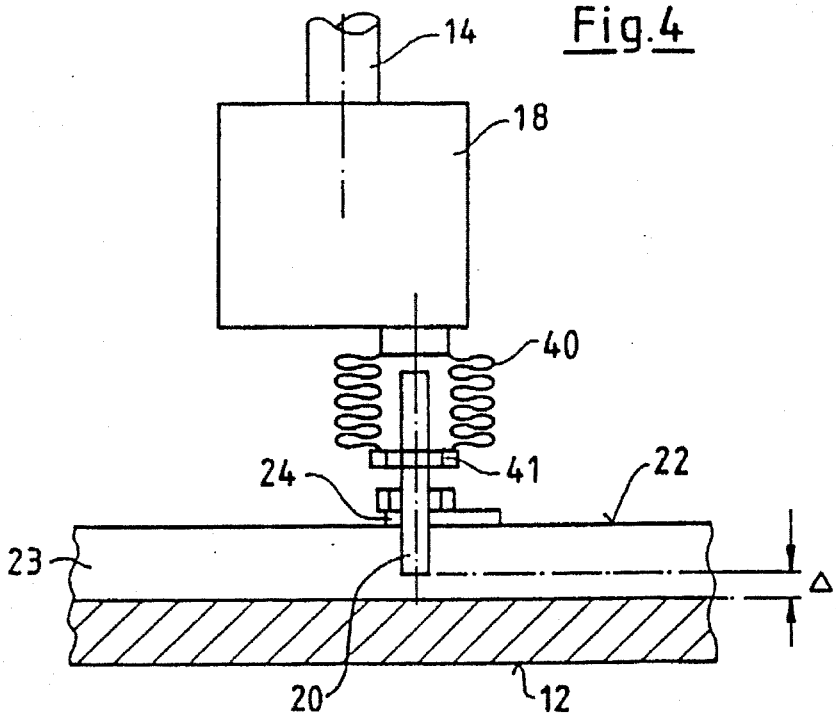
FIG. 4 is a side elevational view, with the condensate evacuation pipes connected to the collector by way of a compensator.
Figure 5:
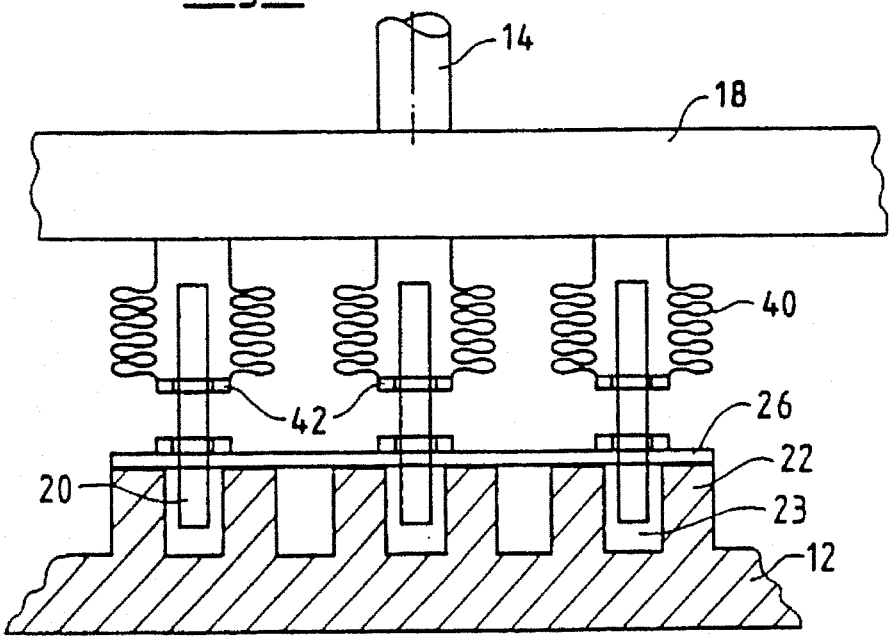
FIG. 5 is a front longitudinal sectional view of the embodiment of FIG. 4.

FIGS. 4 and 5 show a cross section analogous to FIG. 2 and a longitudinal section analogous to FIG. 3, the second embodiment of the functional connection between the condensate evacuation pipes 20, and collector 18. As illustrated in FIG. 1, collector 18 connects to the hollow shaft by way of condensate riser 14. Condensate evacuation pipes 20 are now fixed on ribbing 22 of cylinder shell 12, the same as in FIGS. 2 and 3, with a mounting strap 24 or—bundled—a mounting bar 26, notably screw-joined. Condensate evacuation pipes 20 are coordinated with groove 23, adjustable in height as well as indicated by the Δ symbol.

In the embodiment according to FIGS. 4 and 5, condensate evacuation pipes 20 have an axially parallel orientation relative to condensate riser 14, and the flexible connecting element between condensate evacuation pipes 20 and collector 18 are fashioned each as a compensator 40. Compensator 40 is hooked to the conjugate inlet of collector 18 and, in the assembly of drying cylinder 1, is fixed on a flanged projection 42 of condensate evacuation pipes 20. This differs from the object of the invention relative to the embodiment according to FIGS. 2 and 3 in that the flexible connecting element is not directly a part of the condensate discharge, but participates only indirectly as far as the transition from condensate evacuation pipe 20 to collector 18 is tight in relation to the interior of drying cylinder 1. Also with the embodiment according to FIGS. 4 and 5, no appreciable forces act upon cylinder shell 12. Any problems associated with thermal expansion are eliminated, and wear and/or damage are prevented.

Figure 6:
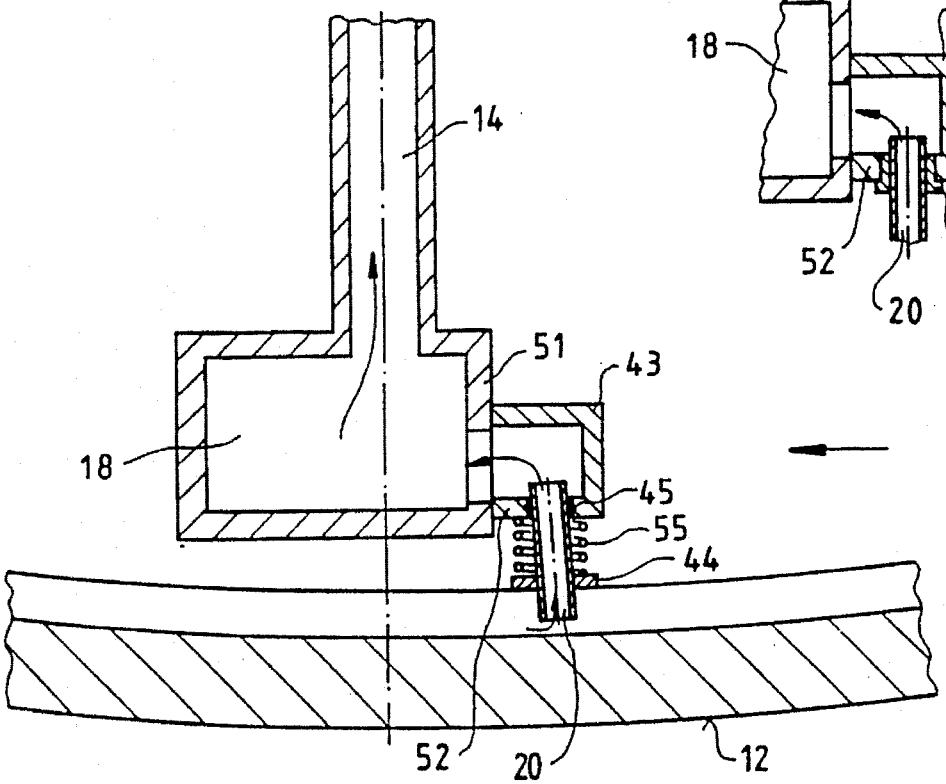
FIG. 6 is a fragmentary side view a third embodiment of the device for condensate removal where the condensate evacuation pipes bear in fixed fashion on the inside wall of the drying cylinder.
Figure 8:
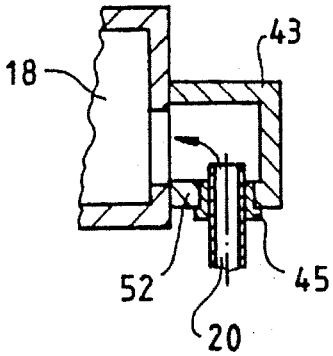
FIG. 8 is an enlarged sectional view of FIG. 6 with a different sealing variant of the condensate evacuation pipes.
Figure 7:
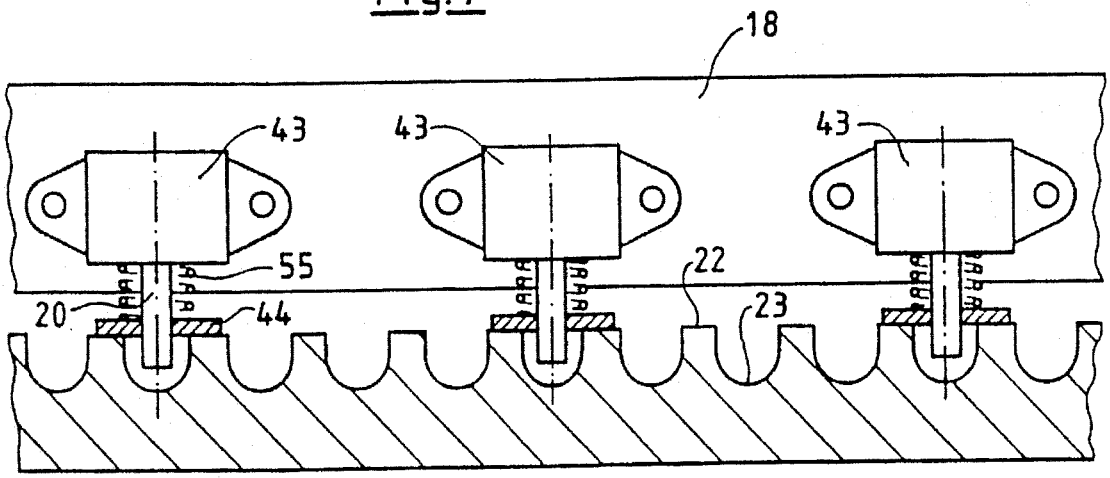
FIG. 7 is a fragmentary, enlarged, longitudinal, sectional view of the third embodiment according to FIG. 6.
Figure 9:
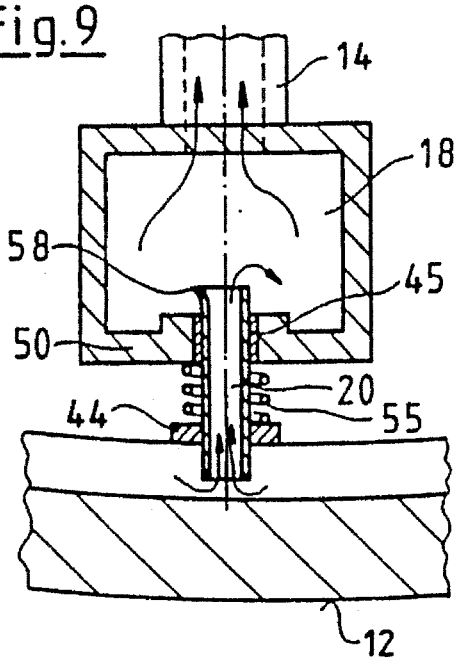
FIG. 9 is an enlarged sectional view of a further variant to the third embodiment, with the condensate evacuation pipes connected directly to the collector.

FIGS. 6 through 10 show further presentations of the functional connection between condensate evacuation pipes 20 and collector 18. Condensate evacuation pipes 20 rest on the inside wall of drying cylinder 1 and bear on two ribs 22 that bound groove 23. This bearing contact is accomplished through a washer 4 attached to each condensate evacuation pipe 20. Instead of washer 44, condensate evacuation pipe 20 may be alternatively fashioned with an integral collar or the like. In order for washer or collar 44 to firmly bear on the inside wall, each condensate evacuation pipe is provided with a compression spring 55 bearing on washer 44 and wall 50 of collector 18 as seen in FIG. 9, or wall 52 of connection box 43 attached to side wall 51 of collector 18 (FIGS. 6 and 7).

Spring 55 enables that at any time, a definitive penetration depth of condensate evacuation pipe 20 in the relevant groove 23 is formed. This also assures that the condensate accumulating in grooves 23 will be evacuated outside through collector 18, condensate risers 14 and hollow shaft 17 in case of thermal expansion or other positional changes (mechanical shifts) of the various components and that thereby the desired (for instance uniform) depth of the remaining condensate film is assured in all grooves.

Essentially, condensate evacuation pipes 20 are arranged so as to be movable relative to collector 18, radially in relation to the peripheral direction of cylinder shell 12. Thus, they are well suited to compensate for movements of collector 18 relative to drying cylinder 1. Likewise assured is a constant tight connection between condensate evacuation pipes 20 and collector 18, or connection boxes 43 attached to its side wall 51. For that purpose, packings 45 are recessed in lower wall 50 of collector 18 (FIG. 9) or lower wall 52 of connection box 43 (FIG. 6 and 8), through which wall extends condensate evacuation pipe 20. Packings 45 are of the sliding type, made of bronze, teflon or similar material. They may be used in the form of O-rings (FIG. 6) or sleeves (FIG. 8 and 9). O-rings allow for any skewing of collector 18 relative to cylinder wall 12.

Illustrated in FIG. 9, additionally, is a flexible finger 58 arranged on the end of condensate evacuation pipe 20 that protrudes into collector 18. This avoids a dropping out of condensate evacuation pipes 20 in the assembly of collector 18.

Figure 10:
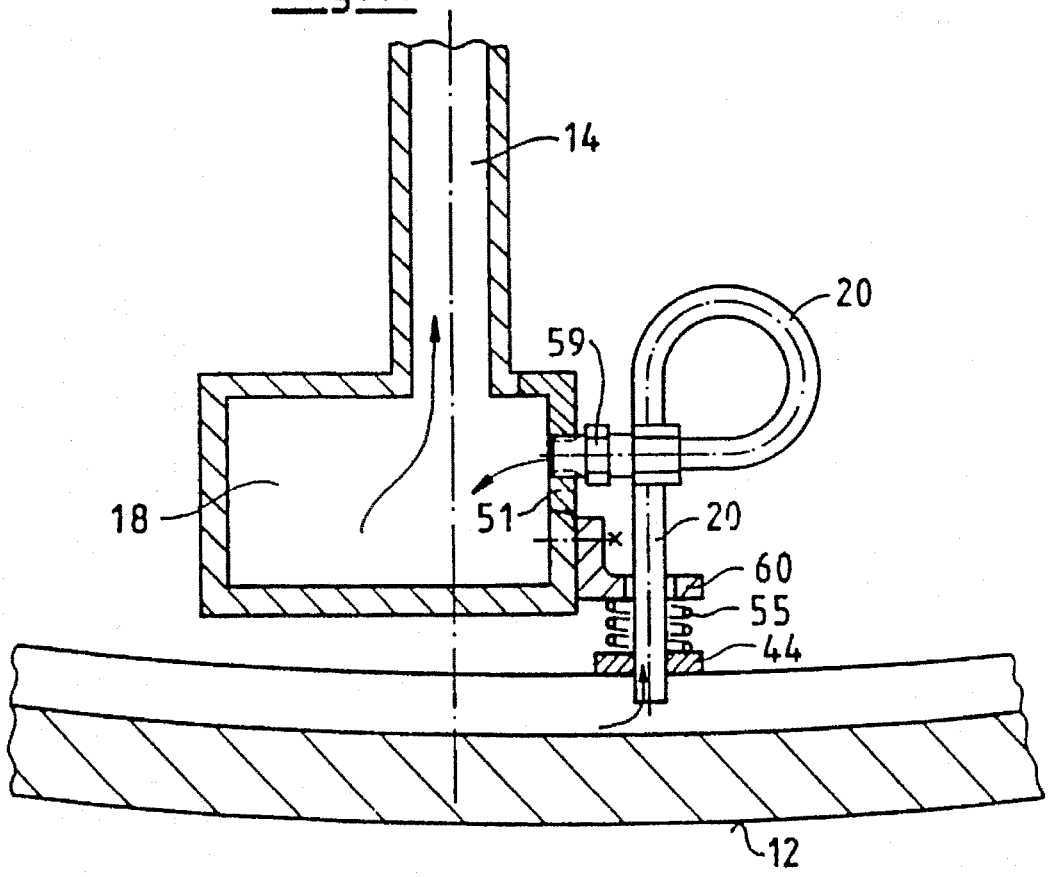
FIG. 10 is an enlarged sectional view of a further variant to the third embodiment, with the condensate evacuation pipes being curvilinear.

Yet another option to compensate for the above relative movements is illustrated in FIG. 10. To that end, condensate evacuation pipe 20 has a curvilinear, respectively meandering or looping shape and is relatively elastic. On one end it is tightly and rigidly connected to side wall 51 of collector 18 by a screw joint 59. The other end extends first with play through a stay 60 attached to side wall 51 of collector 18 and serving to support compression spring 55 (such as in FIGS. 6, 7 and 9 on lower wall 50 or 52), and it is arranged—the same as in the aforementioned embodiments according to FIGS. 6 through 9—at a defined, desired distance from the groove bottom. This variant allows an easier manufacture and assembly and there are no wearing packings needed as in the other embodiments. Besides, the curved shape of condensate evacuation pipes 20 allows greater absorption and compensation of the relative movements than before.

A common feature of FIGS. 2, 3, 6–8, and 10 is that the condensate does not flow into collector 18 from below, but sideways. This facilitates any required exchange of a condensate evacuation pipe 20 (e.g., with a different penetration depth). Such exchange may also be necessitated by clogging of a condensate evacuation pipe 20 after extended use.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for removal of condensate from a rotating, steam heated drying cylinder of a paper making machine, the drying cylinder having a plurality of grooves extending in a peripheral direction on an inside wall of a cylinder shell, said device comprising:

a condensate collector;

a condensate discharge pipe connected to said condensate collector;

a plurality of condensate evacuation pipes, each said condensate evacuation pipe coordinated with a respective groove and extending in a radial direction with respect to the inside wall of the cylinder shell, each said condensate evacuation pipe being spaced apart from and fixed at a corresponding predetermined distance from a groove bottom in the area of the respective groove, each said condensate evacuation pipe being arranged so as to bear firmly on the inside wall of the drying cylinder and to be movable essentially radially to the cylinder shell, each said condensate evacuation pipe also being movable relative to the collector, each said condensate evacuation pipe being fluidly connected to said condensate collector.

2. A device for removal of condensate from a rotating, steam heated drying cylinder of a paper making machine, the drying cylinder having a plurality of grooves extending in a peripheral direction on an inside wall of a cylinder shell, said device comprising:

a condensate collector;

a condensate discharge pipe connected to said condensate collector;

a plurality of condensate evacuation pipes, each said condensate evacuation pipe coordinated with a respective groove and extending in a radial direction with respect to the inside wall of the cylinder shell, each said condensate evacuation pipe being spaced apart from and fixed at a corresponding predetermined distance from a groove bottom in the area of the respective groove; and at least one flexible connecting element connecting said condensate evacuation pipes to said condensate collector.

3. The device of claim 2, wherein said at least one flexible connecting element comprises a plurality of flexible connecting elements branching off the collector and parallel to the peripheral direction of the cylinder shell, each said flexible connecting element comprising a corrugated hose.

4. The device of claim 2, wherein said at least one flexible connecting element comprises a plurality of flexible connecting elements branching off said condensate collector, radially to the peripheral direction of said cylinder shell, each said connecting element comprising a flexible compensator bridging a free space between said condensate evacuation pipes and said condensate collector.

5. A device for removal of condensate from a rotating, steam heated drying cylinder of a paper making machine, the drying cylinder having a plurality of grooves extending in a peripheral direction on an inside wall of a cylinder shell, said device comprising:

a condensate collector;

a condensate discharge pipe connected to said condensate collector;

a plurality of condensate evacuation pipes, each said condensate evacuation pipe coordinated with a respective groove and extending in a radial direction with respect to the inside wall of the cylinder shell, each said condensate evacuation pipe being fixed at a predetermined distance from a groove bottom in the area of the respective groove, each said condensate evacuation pipe being arranged so as to bear firmly on the inside wall of the drying cylinder and to be movable essentially radially to the cylinder shell and relative to the collector, each said condensate evacuation pipe being fluidly connected to said condensate collector, each said condensate evacuation pipe communicating with said condensate collector through a connection box attached to a side wall of said condensate collector, with each said condensate evacuation pipe extending through a wall of said connection box.

6. The device of claim 5, wherein said wall includes a packing through which a respective said condensate evacuation pipe extends.

7. The device of claim 6, wherein said packing is an O-ring.

8. The device of claim 6, wherein said packing is a sleeve.

9. The device of claim 5, wherein said grooves are bounded by two ribs, each said condensate evacuation pipe including a washer disposed against an inside wall of said ribs and bounding a groove.

10. The device of claim 5, wherein said condensate evacuation pipes are curvilinear to compensate for movements relative to said collector, said evacuation pipes being connected to the collector by a tight screw joint recessed in a side wall of said collector.

11. The device of claim 10, wherein said collector side wall includes a stay through which extends said condensate evacuation pipes.

12. The device of claim 11, further comprising a compression spring bearing on the washer and the wall, respective of said stay and being arranged concentrically around a respective said condensate evacuation pipe.

* * * * *

UNITED STATES PATENT AND TRADEMARK OFFICE

CERTIFICATE OF CORRECTION

PATENT NO. : 5,537,756

DATED : July 23, 1996

INVENTOR(S) : Haessner et al.

It is certified that error appears in the above-indentified patent and that said Letters Patent is hereby corrected as shown below:

COLUMN 4

Line 46, delete "washer 4" and substitute --washer 44-- therefor.

Signed and Sealed this

Fifth Day of November, 1996

*Attest:*

Bruce Lehman

BRUCE LEHMAN

*Attesting Officer*

*Commissioner of Patents and Trademarks*